United States Patent [19]

Takamuki et al.

[11] Patent Number: 4,921,781

[45] Date of Patent: May 1, 1990

[54] SILVER HALIDE PHOTOGRAPHIC MATERIAL

[75] Inventors: Yasuhiko Takamuki; Yutaka Uesawa, both of Tokyo, Japan

[73] Assignee: Konica Corporation, Tokyo, Japan

[21] Appl. No.: 244,776

[22] Filed: Sep. 15, 1988

[30] Foreign Application Priority Data

Sep. 18, 1987 [JP] Japan ..... 62-233997
Oct. 8, 1987 [JP] Japan ..... 62-254118

[51] Int. Cl.[5] ..... G03C 1/86

[52] U.S. Cl. ..... 430/496; 430/510; 430/517; 430/538; 430/606; 430/933; 430/950

[58] Field of Search ..... 430/950, 933, 496, 510, 430/517, 538, 606, 933, 950

[56] References Cited

U.S. PATENT DOCUMENTS

| | | | |
|---|---|---|---|
| 3,475,172 | 10/1969 | Bright et al. | 430/139 |
| 4,419,433 | 12/1983 | Kubbota et al. | 430/206 |
| 4,592,991 | 6/1986 | Toshida et al. | 430/139 |
| 4,690,883 | 9/1987 | Kubodera et al. | 430/203 |
| 4,801,509 | 1/1989 | Uno et al. | 430/538 |

FOREIGN PATENT DOCUMENTS 57-64235 4/1982 Japan .

*Primary Examiner*—Paul R. Michl
*Assistant Examiner*—Janet C. Baxter
*Attorney, Agent, or Firm*—Finnegan, Henderson, Farabow, Garrett and Dunner

[57] ABSTRACT

A silver halide photographic material that has a photographic emulsion layer formed on a support comprising paper base coated with a resin on both sides is disclosed. In this photographic material, a hydrophilic colloidal layer containing a material that has an absorption in the wavelength region in which the photographic emulsion layer has sensitivity is provided between the emulsion layer and the support. The surface of the support on the side where the hydrophilic colloidal layer is to be coated has a center-line-average roughness, Ra, of 0.3–1.5 μm, and the thickness of this hydrophilic colloidal layer is at least one half the center-line-average roughness, Ra, of the surface of said support. This photographic material has the advantage of imparting improved sharpness and a high degree of whiteness, as well as high sensitivity.

21 Claims, No Drawings

SILVER HALIDE PHOTOGRAPHIC MATERIAL

BACKGROUND OF THE INVENTION

The present invention relates to a silver halide photographic material, more particularly, to a silver halide photographic material having improved sharpness and a high degree of whiteness.

Silver halide photographic materials are chiefly intended to record optical information, so it is one of the most important capabilities for them to provide faithful spatial reproduction of optical information.

Light incident upon the surface of a light-sensitive material will propagate through the material as it undergoes spatial spread on account of various factors. This spread of light can prevent faithful reproduction of optical information. Major causes of light spread are:

(1) scattering of light on the surface of a light-sensitive material, at the interface between photographic layers, or at the interface between a photographic layer and the support;

(2) scattering of light by silver halide grains in photographic layers, solid particles such as those of a matting agent, or by oil globules; and (3) scattering in the support.

With a view to taking the full advantage of rapid processing, it has recently become popular to use paper base coated on both sides with polyolefins and other resins as supports for silver halide photographic materials. White pigments such as titanium dioxide are usually dispersed in the resin layer on the side of the support where an emulsion layer is coated. The pigment load in the resin is limited for several reasons such as dispersion stability and with titanium dioxide, about 15 wt % is normally the upper limit. However, the pigment load at this level is insufficient to prevent part of the incident light from passing through the resin layer and diffusing into the paper base. The light diffusing into the paper base will pass again through the resin layer to return to photographic layers where it exposes silver halide grains, thereby greatly impairing image sharpness due to blurring or diffusion.

In order to prevent light from diffusing in the paper base, it has been proposed that a hydrophilic colloidal layer containing a dye or colloidal silver be disposed between a photographic emulsion layer and the support to as to absorb the light that might pass through the photographic emulsion layer, thereby reducing the absolute amount of light that will reach the paper base. The hydrophilic colloidal layer disposed between a photographic emulsion layer and the support to attain this purpose is generally referred to as an anti-halation layer and is described in such references as Research Disclosure, vol. 175, Item 17559, November 1978, pp. 53–54 and ibid., vol. 187, Item 18716, November 1979, pp. 649–650.

In the case of photographic paper for photo type setting such as computerized photo type setting, the processed paper is often used as an original for process camera. If the surface of this paper has an unduly high gloss, image deterioration can occur on account of "flare". In order to prevent this problem, the surface of light-sensitive materials is usually given a mat finish. Two methods are known for attaining this purpose: one is to mat the surface of the support, and the other is to incorporate a matting agent in the topmost layer of the light-sensitive material. If the second method alone is used to reduce gloss, a considerable drop in photographic density will occur, so instead, a matted support is usually employed. In order to realize rapid processing, photographic paper for photo type setting also commonly employs a support composed of a paper base that is coated on both sides with resins such as polyolefins. For the purpose of preventing flare during shooting with a camera and to minimize possible decrease in photographic density, the degree of matting of the surface of the support for this type of photographic paper is usually adjusted to lie within the range of 0.3–1.5 μm in terms of center-line-average roughness, Ra, as defined in JIS B 0601 as follows:

Definition of Ra

When a portion having a length l to be measured is taken out from a rough curve in the direction of its center line, the center line of said taken-out portion is set as X-axis with the direction of longitudinal magnification as Y-axis, and the rough curve is expressed by $y=f(x)$, the value of Ra given by the following equation that is expressed with a micrometer unit (μm) is referred to as the center-line-average roughness, Ra:

$$Ra = \frac{1}{l} \int_0^l |f(x)|\, dx$$

The length to be measured, in principle, takes a value three times the cut-off value or greater.

A major problem associated with the use of supports having a matted surface has been that light transmitting photographic emulsion layers will undergo random reflection on the surface of the support to cause serious deterioration of image sharpness. It has been anticipated that the already described method of providing an anti-halation layer between the support and an emulsion layer would also be effective for photographic paper that uses a matted support but a specific manner in which sharpness can be improved with more efficiency has not yet been known.

Silver halide photographic materials spectrally sensitized to infrared light have recently been proposed since the use of an exposing light source that emits light in the infrared region is compatible with the use of a bright safelight and provides great convenience in handling jobs. Even this new class of light-sensitive materials is not immune to the above-described problem of sharpness. These light-sensitive materials can be exposed and processed for image formation by "a scanner method". Image formation by a scanner method involves scanning of the original, exposing on a silver halide photographic material based on the resulting image signal, and forming a negative or positive image corresponding to the image on the original. This method of image formation has been adopted in various recording apparatus that use a glow lamp, a xenon lamp, a mercury lamp, a tungsten lamp, a light-emitting diode, etc. as recording light sources. However, these light sources are impractical in that they produce low outputs and are short-lived. In order to solve this problem, scanners have been proposed that employ coherent light sources including a helium-neon laser, an argon laser and a helium-cadmium laser. These light sources have the advantage of producing high outputs due at the same time, they suffer from various disadvantages in that they are expensive, require a modulator and are not convenient in handling since the use of visible light limits the kind of safelight that can be used with light-sensitive materials.

Compared with these conventional lasers, a semiconductor laser is small in size, inexpensive, allows for easy modulation and is long-lived. It has the additional advantage of providing greater convenience in handling since it emits light in the infrared region and hence permits the use of a bright safelight. Because of these advantages, semiconductor lasers are suitable for use with silver halide photographic materials spectrally sensitized in the infrared region.

The use of brighteners for the specific purpose of improving the whiteness of processed silver halide photographic materials is a well known technique. Oil-soluble brighteners are preferred to water-soluble ones since they are less prone to leaching during development and subsequent processing. As typically shown in British Pat. No. 1,072,915, Japanese Patent Publication No. 37376/1970 and Japanese Patent Application (OPI) No. 134232/1985 (the term OPI as used herein means an unexamined published Japanese patent application), oil-soluble brighteners can be incorporated in light-sensitive materials after they are dissolved in organic solvents to form emulsified dispersions.

The present inventors, however, found by experiment that satisfactory brightening effects could not necessarily be attained when oil-soluble brighteners were applied to silver halide photographic materials spectrally sensitized in the infrared region.

SUMMARY OF THE INVENTION

An object, therefore, of the present invention is to provide a silver halide photographic material capable of producing improved image sharpness and which employs a support that comprises paper base coated with resin on both sides and the surface of which is matted to have a predetermined surface roughness.

Another object of the present invention is to provide a silver halide photographic material of high sensitivity that is spectrally sensitized in the infrared region and which imparts a high degree of whiteness.

These objects of the present invention can generally be attained by a silver halide photographic material that has a photographic emulsion layer formed on a support comprising a paper base coated with a resin on both sides. Specifically, a hydrophilic colloidal layer containing a material that has an absorption in the wavelength region in which the photographic emulsion layer has sensitivity is provided between the emulsion layer and the support. The surface of the support on the side where the hydrophilic colloidal layer is to be coated has a center-line-average roughness, Ra, of 0.3–1.5 μm, and the thickness of this hydrophilic colloidal layer is at least one half the center-line-average roughness, Ra, of the surface of said support.

DETAILED DESCRIPTION OF THE INVENTION

A material that has an absorption in the wavelength region in which a photographic emulsion layer has sensitivity is incorporated in a hydrophilic colloidal layer to be disposed between the photographic emulsion layer and the support of the silver halide photographic material of the present invention. This material, which is hereunder referred to as "the material of the present invention", may be exemplified by dyes, pigments, colloidal silver, etc. Dyes, in particular, those containing acid groups are desirable since they produce a high degree of whiteness for photographic paper such as one for computerized phototypesetting that is to be processed in short periods without requiring the step of silver removal.

Dyes that can be used as the material of the present invention include cyanine dyes, hemicyanine dyes, streptocyanine dyes, merocyanine dyes, oxonole dyes, hemioxonole dyes, styryl dyes, rhodacyanine dyes, neocyanine dyes, azo dyes, anthraquinone dyes, etc. Among these dyes, those which contain at least one acid group such as a sulfo or carboxy group are preferred since they produce less pronounced residual color after processing.

Dyes that can be used in the present invention are listed below by type (i.e., uv absorbing dyes, yellow dyes, red dyes, blue dyes and near infrared absorbing dyes), each being accompanied by specific examples. Needless to say, these are not the sole examples of the material of the present invention that can be used.

UV absorbing dyes

I-1

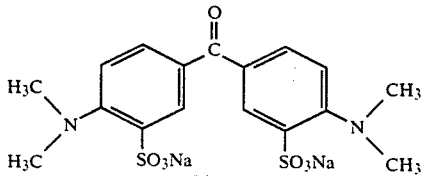

I-2

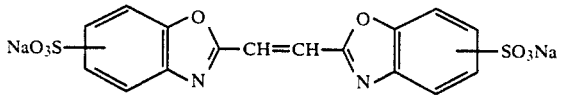

I-3

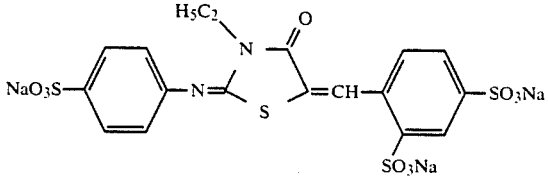

-continued
I-4
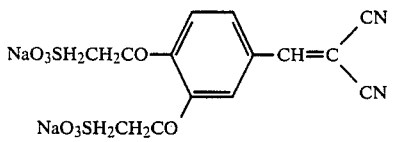
I-5
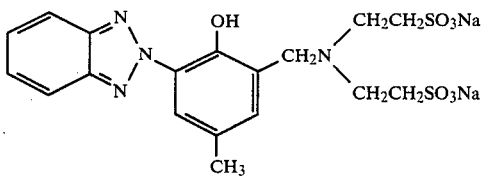
I-6
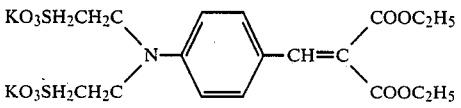
I-7
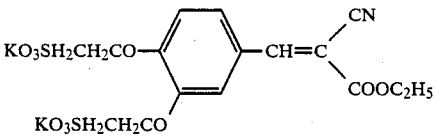
I-8
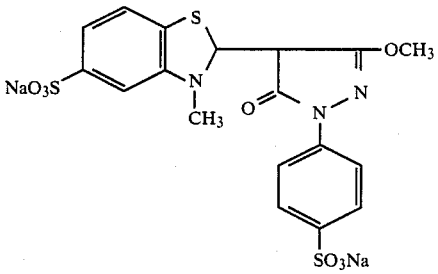
Yellow dyes
II-1
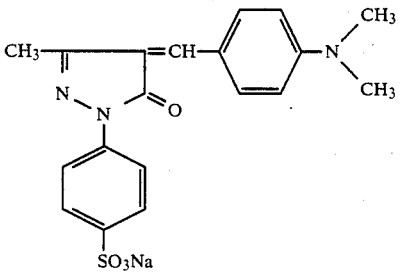
II-2
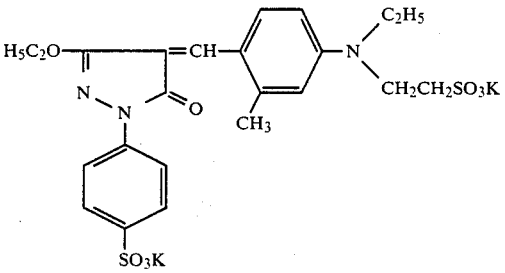

-continued
II-3
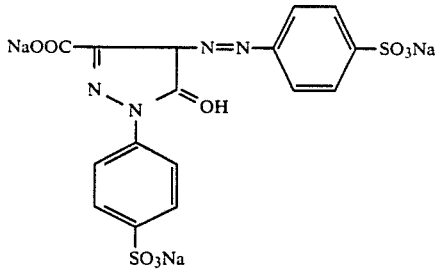
II-4
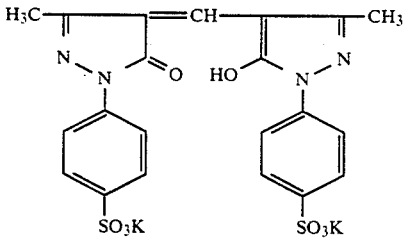
II-5
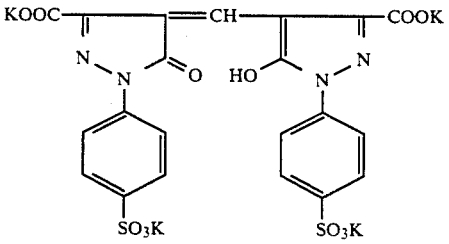
II-6
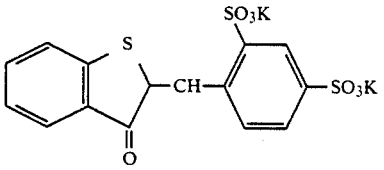
II-7
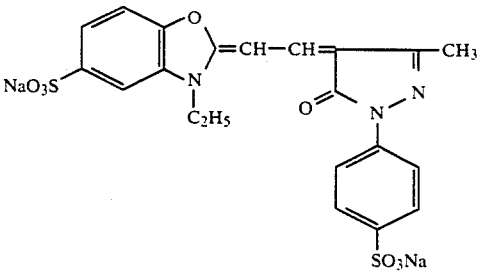
II-8
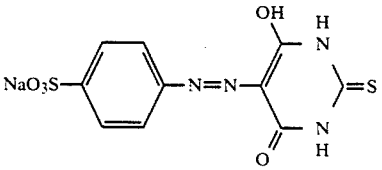

-continued
II-9
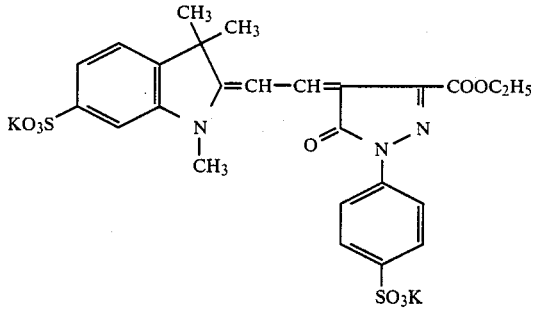
Red dyes
III-1
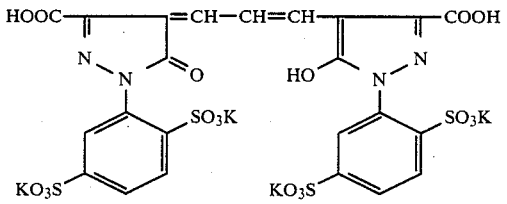
III-2
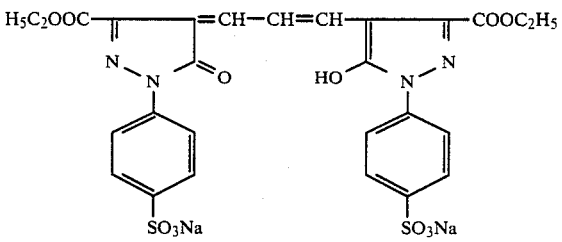
III-3
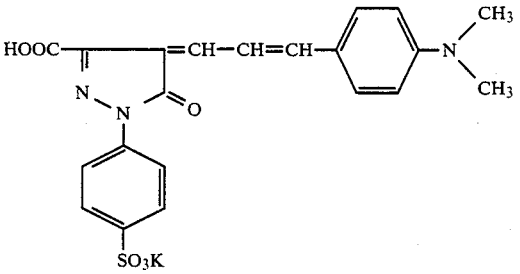
III-4
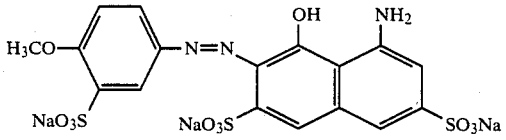
III-5
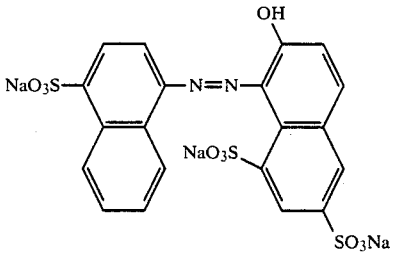
III-6
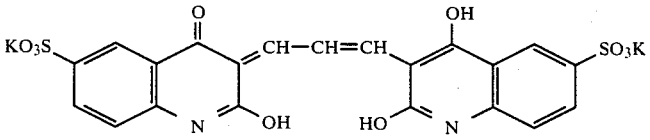

-continued
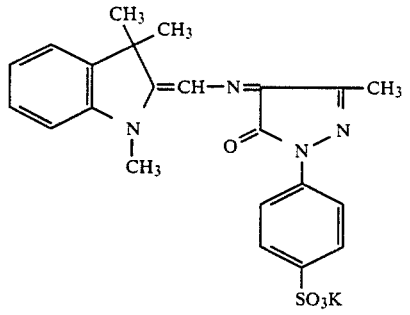
III-7
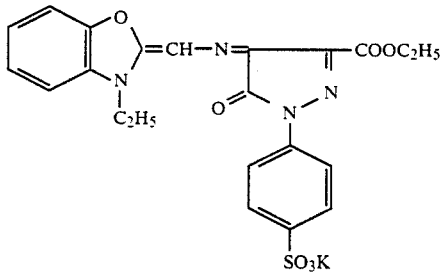
III-8
Blue dyes
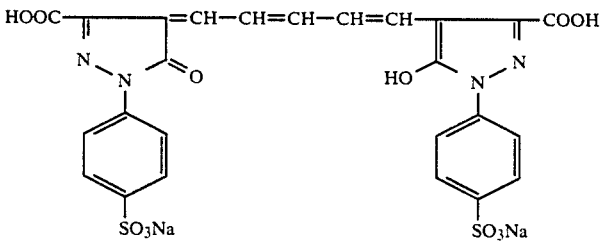
IV-1
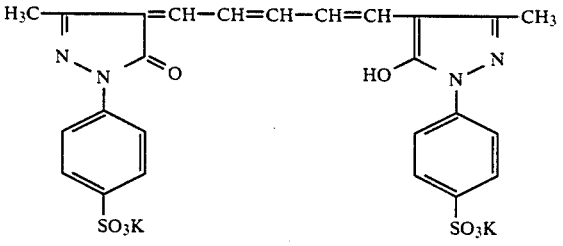
IV-2
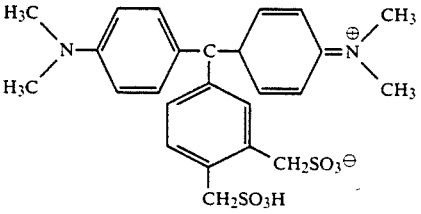
IV-3
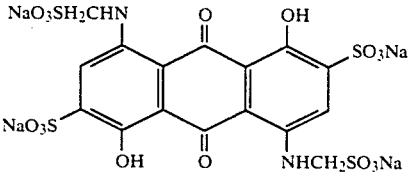
IV-5

-continued
IV-5
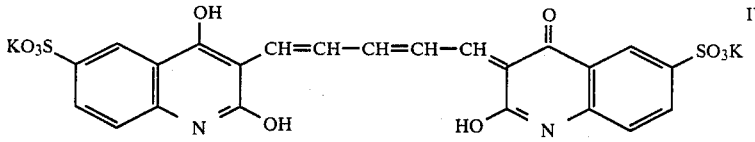
IV-6
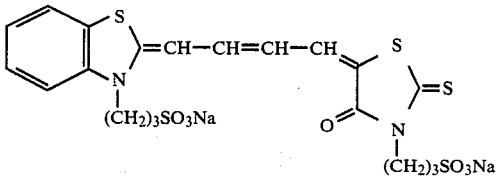
IV-7
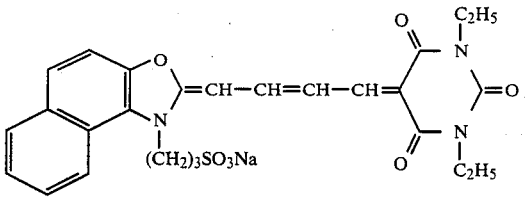
IV-8
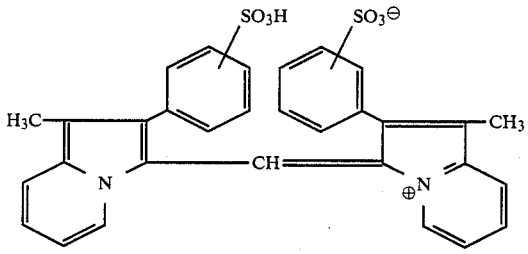
IV-9
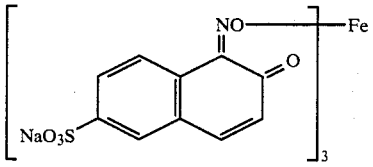
Near infrared absorbing dyes
V-1
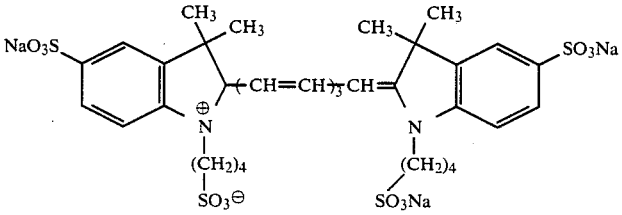
V-2
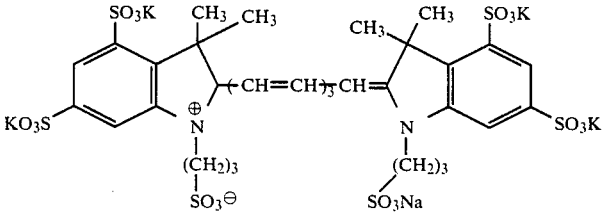

-continued

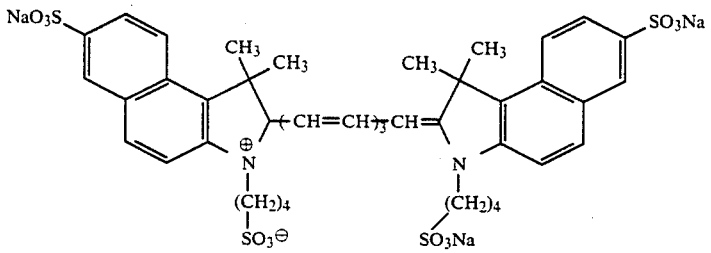

V-3

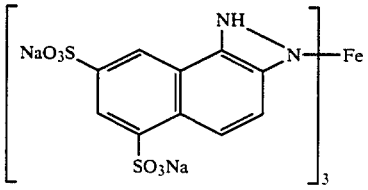

V-4

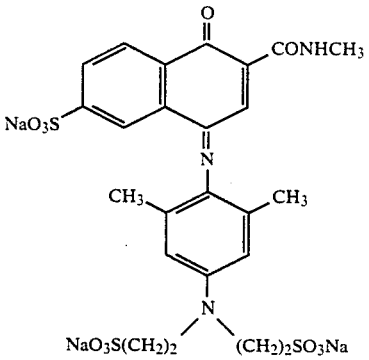

V-5

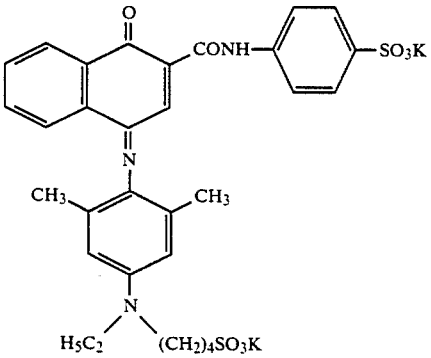

V-6

The material of the present invention may be of any type of compound that has an absorption in the wavelength region in which a photographic emulsion layer has sensitivity. The material of the present invention is desirably incorporated in such an amount that the reflection density of the photographic emulsion layer at the wavelength of maximum sensitivity is at least 0.1, more preferably at least 0.3.

The hydrophilic colloidal layer containing the material of the present invention must have a thickness which is at least one half the center-line-average roughness, Ra, of the surface of the support. Preferably, its thickness is not smaller than Ra. If the thickness of the hydrophilic colloidal layer containing the material of the present invention is less than one half the value of Ra, deterioration of sharpness will result even if the coating weight of the material, such as dye, of the present invention is the same. If the thickness of the hydrophilic colloidal layer is excessive, problems will also arise including poor dryability in development and subsequent processing. As a practical guide, the hydrophilic colloidal layer is desirably not thicker than 2 μm.

Gelatin is advantageously used as the hydrophilic colloid of which the hydrophilic colloidal layer is to be composed. Other usable hydrophilic colloids include gelatin derivatives, graft polymers of gelatin and other polymers, other proteins, sugar derivatives, cellulosic derivatives, an synthetic hydrophilic polymers including homo- and copolymers.

Plasticizers may be incorporated in the hydrophilic colloidal layer for the purpose of providing higher flexibility. To attain other purposes including improvement of dimensional stability, latices, or dispersions of water-insoluble or slightly soluble synthetic polymers may be incorporated in the hydrophilic colloidal layer.

The hydrophilic colloidal layer can be hardened with one or more hardeners which crosslink the molecules of a binder (or protective colloid) to provide a stronger film.

The present invention is preferably applied to a silver halide photographic paper in which a silver halide emulsion layer is spectrally sensitized with either a cationic tricarbocyanine dye or a cationic dicarbocyanine dye or both and which contains an emulsified dispersion or latex dispersion of an oil-soluble brightener in at least one hydrophilic colloidal layer including said silver halide emulsion layer which is coated on the same side as where said silver halide emulsion layer is disposed.

Such a photographic paper has at least one hydrophilic colloidal layer including a silver halide emulsion layer formed on the support. Hydrophilic colloidal layers other than the emulsion layer may be formed as desired and include such layers as a protective layer, an intermediate layer and a backing layer., In the above-described silver halide photographic paper, a silver halide emulsion layer (if more than one silver halide emulsion layer is present, at least one such emulsion layer) is spectrally sensitized with either a cationic tricarbocyanine dye or a cationic dicarbocyanine dye or both. These dyes are also capable of working as sensitizing dyes that impart sensitivity in the infrared region.

As such sensitizing dyes, compounds represented by the following general formulas (I-a) and (I-b) are preferably used:

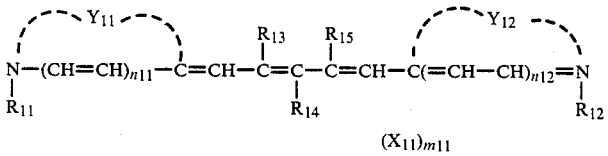

(I-a)

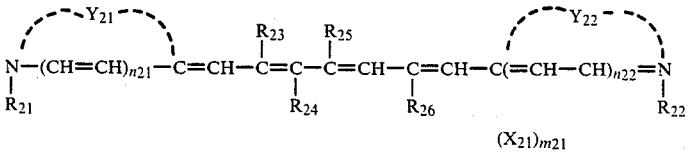

(I-b)

where $Y_{11}$, $Y_{12}$, $Y_{21}$ and $Y_{22}$ each represents the nonmetallic atomic group necessary to complete a 5- or 6-membered nitrogenous heterocyclic ring and may be exemplified by, for example, a benzothiazole ring, a naphthothiazole ring, a benzoselenazole ring, a naphthoselenazole ring, a benzoxazole ring, a naphthoxazole ring, a quinoline ring, a 3,3-dialkylindolenine ring, a benzimidazole ring, and a pyridine ring. These heterocyclic rings may be substituted by a lower alkyl group, an alkoxy group, a hydroxyl group, an aryl group, an alkoxycarbonyl group or a halogen atom.

In formulas (I-a) and (I-b), $R_{11}$, R12, $R_{2}$l and $R_{22}$ each represents a lower alkyl group, an alkyl group having a sulfo group, or an alkyl group having a carboxyl group; $R_{13}$, $R_{14}$, $R_{15}$, $R_{23}$, $R_{24}$, $R_{25}$ and $R_{26}$ each represents a hydrogen atom, a substituted or unsubstituted alkyl, alkoxy, phenyl or benzyl group or substituted or unsubstituted

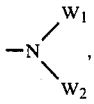

where $W_1$ and $W_2$ each signifies a substituted or unsubstituted alkyl (the alkyl portion preferably has 1–18, more preferably 1–4, carbon atoms) or aryl group, provided that $W_1$ and $W_2$ may combine with each other to form a 5- or 6-membered nitrogenous heterocyclic ring.

In formulas (I-a) and (I-b), $R_{13}$ and $R_{15}$ or $R_{23}$ and $R_{25}$ may combine with each other to form a 5- or 6-membered ring; $X_{11}$ and $X_{21}$ each represents an anion; $n_{11}$, $n_{12}$, $n_{21}$ and $n_{22}$ each represents 0 or 1; $m_{11}$ and $m_{21}$ each represents 1 or 0 (an intramolecular salt is represented if they are 0).

The following are non-limiting examples of the sensitizing dyes that are represented by the general formulas (I-a) and (I-b) and which can be used in the present invention. Compounds I-1 to I-8 listed below are represented by the general formula (I-b) and compounds I-9 to I-14 are those which are represented by the general formula (I-a).

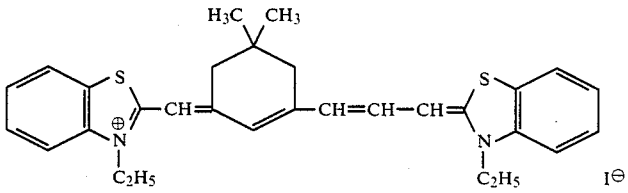

I-1

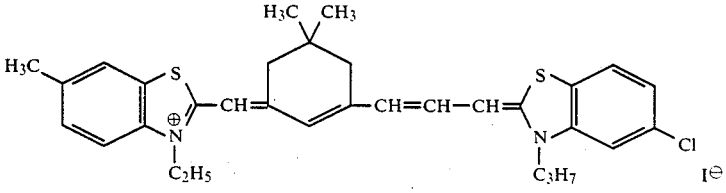

I-2

-continued
I-3
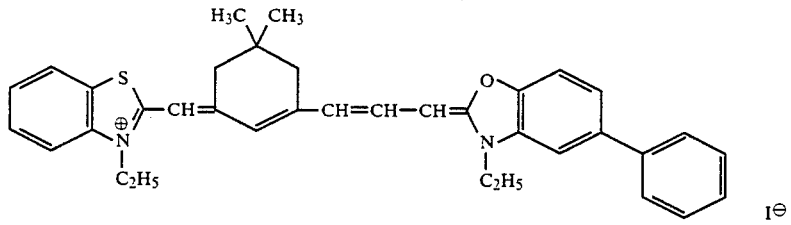
I-4
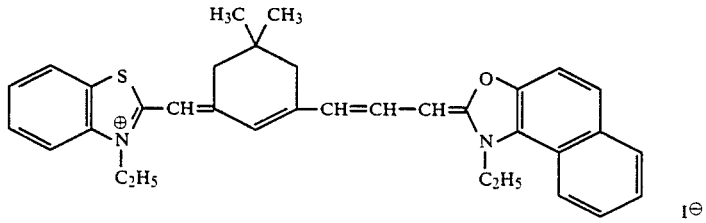
I-5
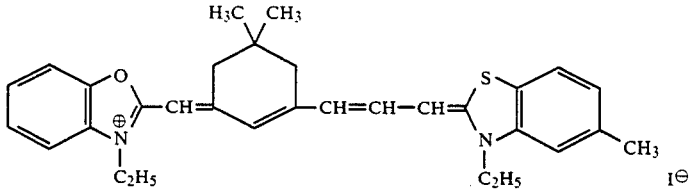
I-6
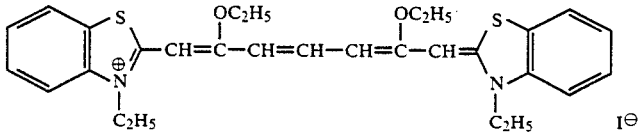
I-7
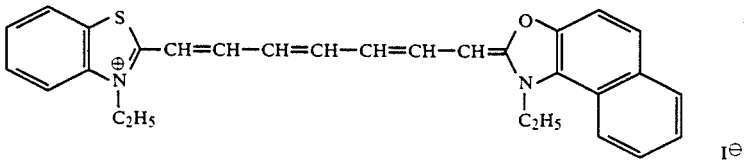
I-8
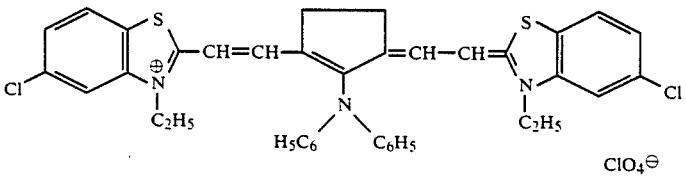
I-9
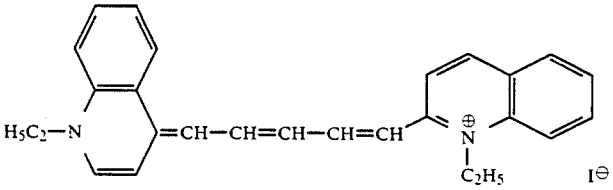
I-10
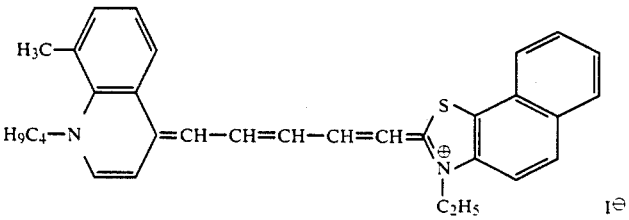

-continued

I-11

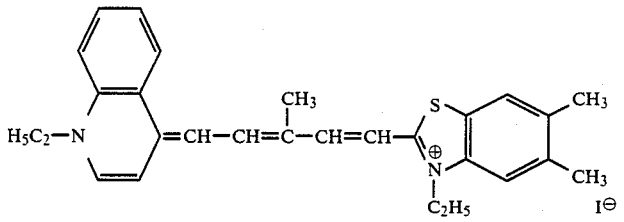

I-12

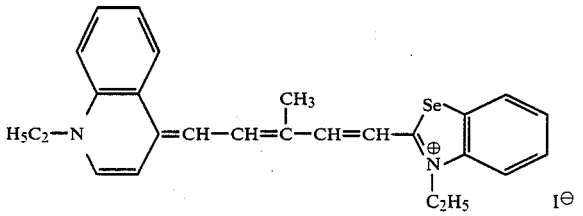

I-13

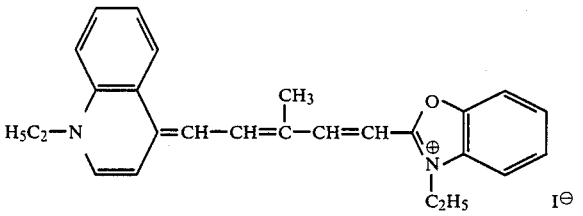

I-14

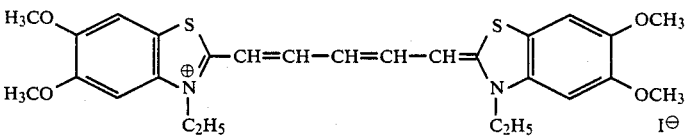

In the present invention, the sensitizing dyes described above are incorporated in a silver halide photographic emulsion in an amount that preferably ranges from 1 mg to 2 g, more preferably from 5 mg to 1 g, per mole of silver halide.

The sensitizing dyes useful in the present invention may be directly dispersed in emulsions. If desired, they may be added as solutions to the emulsion after they have been dissolved in appropriate solvents including methyl alcohol, ethyl alcohol, methyl cellosolve, acetone, water, pyridine and mixtures thereof.

The sensitizing dyes listed about may be used either independently or as admixtures. They may also be used in combination with other types of sensitizing dyes. When sensitizing dyes are used in combination, their total amount is preferably within the range specified above.

The sensitizing dyes described above can readily be synthesized by those skilled in the art by referring to U.S. Pat. No. 2,503,776, BP No. 742,112, FP No. 2,065,662 and Japanese Patent Publication No. 2346/1965.

In the photographic paper described above, an oil-soluble brightener is incorporated in at least one hydrophilic colloidal layer that is coated on the same side of the support as where an emulsion layer spectrally sensitized with a cationic tri- or dicarbocyanine dye is formed. Examples of the oil-soluble brightener that is useful in the present invention are the substituted stilbene and coumarin that are shown in BP No. 786,234 and the substituted thiophenes shown in U.S. Pat. No. 3,135,762. Oil-soluble brighteners of the types that are shown in Japanese Patent Publication No. 37376/1970 and Japanese Patent Application (OPI) No. 126732/1975 may be used with particular advantage.

Typically useful oil-soluble brighteners include those which have one of the general formulas noted below under (II-a) to (II-d):

(II-a)

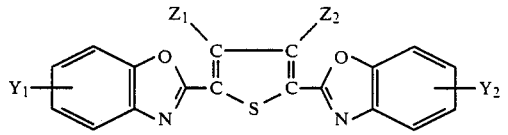

(II-b)

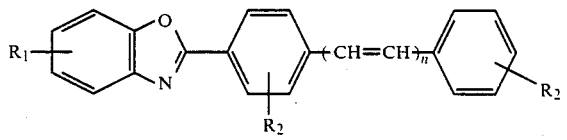

-continued

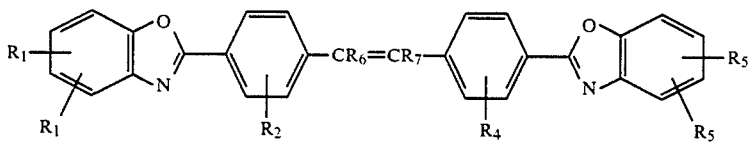

(II-c)

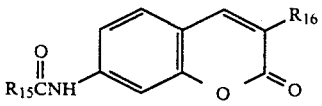

(II-d)

In these general formulas (II-a) to (II-d), $Y_1$ and $Y_2$ each represents an alkyl group; $Z_1$ and $Z_2$ each represents a hydrogen atom or an alkyl group; n is 1 or 2; $R_1$, $R_2$, $R_4$ and $R_5$ each represents an aryl, alkyl, alkoxy, aryloxy, hydroxyl, amino, cyano, carboxyl, amido, ester, alkylcarbonyl, alkylsulfo or dialkylsulfonyl group or a hydrogen atom; $R_6$ and $R_7$ each represents a hydrogen atom, an alkyl group (e.g., methyl or ethyl) or a cyano group; $R_{16}$ is a phenyl group, a halogen atom, or an alkyl-substituted phenyl group; and $R_{15}$ is an amino group or an organic primary or secondary amine.

Preferred examples of the oil-soluble brightener that may be used in the present invention are listed below under II-1 to II-16. Needless to say, these are not the sole examples of the oil-soluble brightener that can be used in the present invention.

II-1

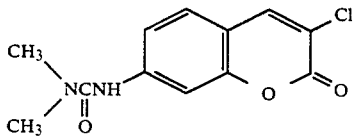

II-2

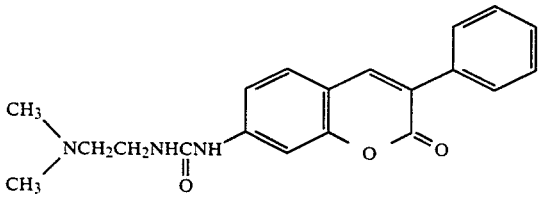

II-3

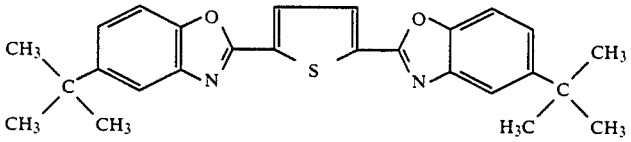

II-4

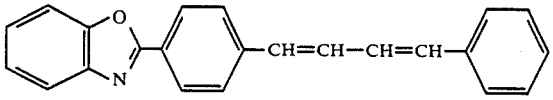

II-5

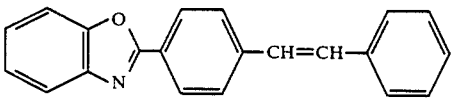

II-6

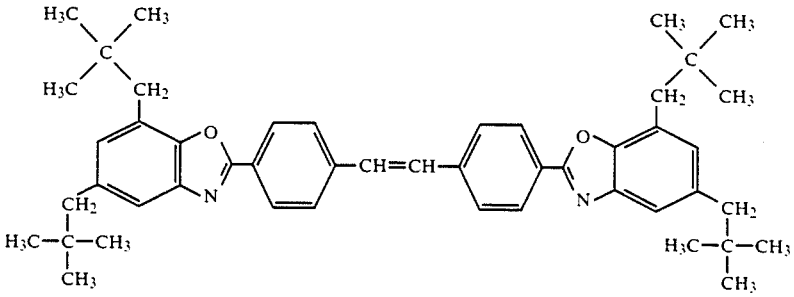

-continued

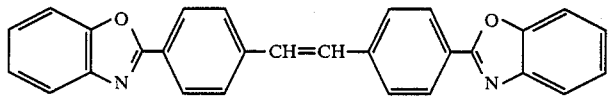

II-7

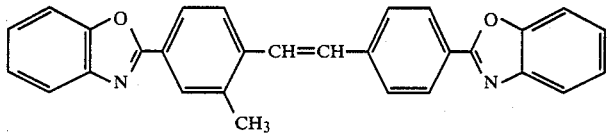

II-8

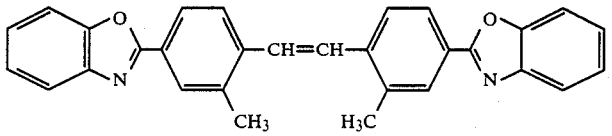

II-9

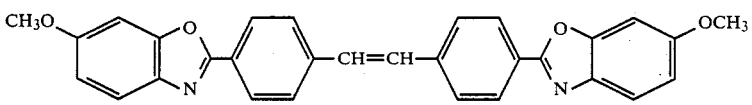

II-10

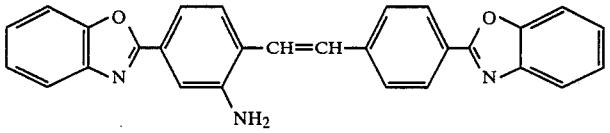

II-11

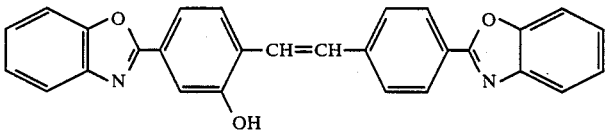

II-12

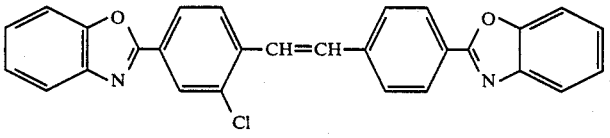

II-13

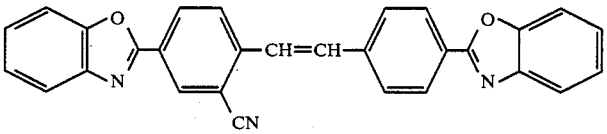

II-14

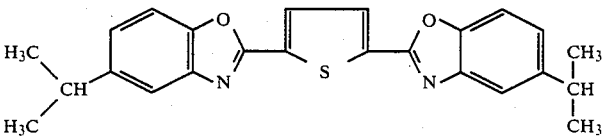

II-15

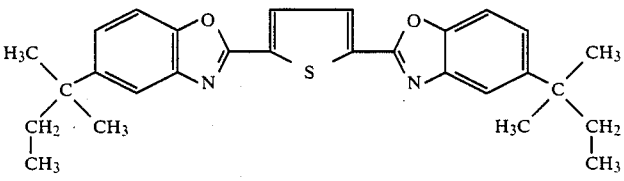

II-16

The above-described oil-soluble brighteners may be used either on their own or as admixtures. These oil-soluble brighteners are preferably used in such amounts that they will be present in an amount of 1–200 mg/m$^2$, most preferably 5–50 mg/m$^2$, in finished photographic paper.

The emulsified dispersion of the oil-soluble brightener used in the present invention may be incorporated in any photographic constituent layer on the support but from the viewpoint of antiblooming, the dispersion is preferably incorporated in a silver halide emulsion layer or a hydrophilic colloidal layer that is situated closer to the support.

The oil-soluble brighteners may be incorporated in the light-sensitive material of the present invention by a method which is commonly employed for incorporating oil-soluble couplers or oil-soluble uv absorbers. Stated more specifically, the oil-soluble brightener is dissolved in a high-boiling point organic solvent, optionally together with a low-boiling point solvent; the solution is mixed with an aqueous gelatin solution containing a surfactant; and the resulting mixture is emulsified with a suitable apparatus such as a colloid mill, a homogenizer or an ultrasonic disperser to form an emulsified dispersion which then is incorporated in the light-sensitive material.

The term "high-boiling point solvent" as used herein means a solvent having a boiling point higher than 200° C. High-boiling point solvents that can be used in the present invention include carboxylic acid esters, phosphoric acid esters, carboxylic acid amides, ethers and substituted hydrocarbons. More specific examples include: di-n-butyl phthalate, di-iso-octyl phthalate, dimethoxyethyl phthalate, di-n-butyl adipate, diisooctyl azelate, tri-n-butyl citrate, butyl laurate, di-n-sebacate, tricresyl phosphate, tri-n-butyl phosphate, triisooctyl phosphate, N,N-diethylcaprylamide, N,N-dimethylpalmitylamide, n-butyl-pentadecylphenylether, ethyl-2,4-tert-butylphenylether, succinate esters, maleate esters and chlorinated paraffin. These solvents may be used either on their own or as admixtures. Illustrative low-boiling solvents include: ethyl acetate, butyl acetate, cyclohexane, propylene carbonate, methanol, sec-butyl alcohol, tetrahydrofuran, dimethylformamide, benzene, chloroform, acetone, methyl ethyl ketone, diethyl sulfoxide and methyl cellosolve. These solvents may be used either independently or as admixtures. Surfactants that can be used include anionic surfactants, nonionic surfactants and combinations thereof. Examples are alkylbenzenesulfonate, sulfosuccinate esters, and saponin. Useful gelatins include gelatin produced by alkaline processing, gelatin produced by acid processing and gelatin produced by modifications of these processes (as shown in Japanese Patent Publication Nos. 4854/1963 and 12237/1965, and U.S. Pat. No. 2,525,753). These gelatins may be used either independently or in combination. Natural or synthetic binders (e.g., polyvinyl alcohol and polyvinylpyrrolidone) may be used as required.

Oil-soluble brighteners may be incorporated in the light-sensitive material of the present invention by other methods such as dissolving them in monomers, followed by polymerization to form a latex dispersion, or impregnating the brighteners in hydrophobic polymer latices with the aid of auxiliary solvents, followed by incorporation as a latex dispersion. These methods are shown in such patents as Japanese Patent Application (OPI) NO. 126732/1975, Japanese Patent Publication No. 47043/1976, U.S. Pat. No. 3,418,127, 3,359,102, 3,558,316 and 3,788,854.

The photographic emulsion layer in the silver halide photographic material of the present invention contains a light-sensitive silver halide emulsion. For practical applications of the present invention, the silver halide emulsion as the major component of a photographic emulsion layer may contain any kind of silver halides that are used in ordinary silver halide emulsions, such as silver bromide, silver iodobromide, silver iodochloride, silver chlorobromide, silver chloroiodobromide and silver chloride.

The silver halide grains used in the silver halide emulsion may be prepared by either the acid method, neutral method or ammoniacal method. The grains may be grown at one time or they may be grown after making of seed grains. The method of making seed grains may be the same as or different from the method of growing them.

In preparing a silver halide emulsion, halide ions and silver ions may be mixed as such or, alternatively, either halide ions or silver ions may be mixed with a solution containing the other ion. Silver halide grains can also be produced by simultaneously adding halide ions and silver ions over time with the pH and pAg in the mixing vessel being controlled in consideration of the critical growth rate of silver halide crystals. This latter method has the advantage of producing silver halide grains that are regular in crystallographic form and which are substantially uniform in grain size. After the grain growth, the halide composition of the grains may be altered by a conversion process.

If desired, a silver halide emulsion may be produced in the presence of a silver halide solvent for the purpose of controlling various parameters including the size of silver halide grains, their shape, grain size distribution and the growth rate of grains.

In the process of formation and/or growth of silver halide grains used in a silver halide emulsion, at least one metal ionic species selected from the group consisting of cadmium salt, zinc salt, lead salt, thallium salt, iridium salt (or a complex salt containing the same), a a rhodium salt (or a complex salt containing the same) and an iron salt (or a complex salt containing the same) may be added so that these metallic elements may be present within and/or on the grains. Alternatively, the grains may be placed in a suitable reducing atmosphere so as to provide reduction sensitization nuclei within and/or on the grains.

In the preparation of silver halide emulsions, unwanted soluble salts may be removed after completion of the growth of silver halide grains. If desired, such soluble salts may be left unremoved from the grown silver halide grains. Removal of such soluble salts may be accomplished by the method described in Research Disclosure No. 17643.

The silver halide grains used in the present invention may have a homogeneous distribution of silver halide composition throughout the grain; alternatively, they may be core/shell grains having different silver halide compositions in the interior and surface layer of the grain.

The silver halide grains used in the present invention may be either such that latent image is predominantly formed on their surface or such that it is predominantly formed within the grain.

The silver halide grains used in the present invention may have a regular crystallographic form such as a cube, an octahedron or a tetrahedron, or they may have an anomalous crystallographic form such as a sphere or a plate. These grains may have any proportions of {100} and {111} faces. Grains having combinations of these crystallographic forms may also be used. Grains having various crystallographic forms may be used as admixtures.

The silver halide grains preferably have an average size (as expressed by the diameter of an equivalent circle whose area is the same as the projected) of no more than 2 μm, with 1 μm or below being particularly preferred.

The silver halide emulsion used in the present invention may have any grain size distribution. It may have a broad grain size distribution (i.e., a polydispersed emulsion). Alternatively, emulsions having a narrow grain size distribution (i.e., monodispersed emulsions, or emulsions in which the standard deviation of grain size distribution divided by the average grain size is no more than 0.20, where the grain size is expressed by the diameter of a spherical silver halide grain, or the diameter of the projected area of a non-spherical grain as reduced to a circular image of the same area) may be used either independently or as admixtures. If desired, a polydispersed emulsion may be used as an admixture with a monodispersed emulsion.

Two or more silver halide emulsions separately prepared may be used as admixtures.

Depending upon a specific object, the light-sensitive material of the present invention may incorporate various additives in the photographic emulsion layer described above, or a hydrophilic colloidal layer, or some other constituent elements. A detailed description of useful additives is given in Research Disclosure (RD), vol. 176, Item 17643 (Dec. 1978) and ibid., vol. 187, Item 18716 (Nov. 1979) and the relevant portion of the description is summarized in the table below.

There is no particular limitation on the conditions for exposure, development and subsequent processing of the light-sensitive material of the present invention and reference may be had to the description in Research Disclosure, vol. 176, Item 17643 (Dec. 1978), pp. 28–30.

| | Additive | RD 17643 | RD 18716 |
|---|---|---|---|
| 1. | Chemical sensitizer | p. 23 | p. 648, right col. |
| 2. | Sensitivity improver | | p. 648, right col. |
| 3. | Spectral sensitizer Supersensitizer | pp. 23–24 | p. 648, right col. to p. 649, right col. |
| 4. | Bleaching agent | p. 24 | |
| 5. | Antifoggant Stabilizer | pp. 24–25 | p. 649, right col. |
| 6. | Light absorber Filter dye | pp. 25–26 | p. 649, right col. to p. 650, left col. |
| 7. | Antistain agent | p. 25, right col. | p. 650, left and right col. |
| 8. | Dye image stabilizer | p. 25 | |
| 9. | Hardener | p. 26 | p. 651, left col. |
| 10. | Binder | p. 26 | p. 651, left col. |
| 11. | Plasticizer Lubricant | p. 27 | p. 650, right col. |
| 12. | Coating aid Surfactant | pp. 26–27 | p. 650, right col. |
| 13. | antistat | p. 27 | p. 650, right col. |

The support of the silver halide photographic material of the present invention is a paper base coated with a resin on both sides. A polyolefin resin is preferably used as the coating on the paper base. Illustrative polyolefin resins include: homopolymers such as low-density polyethylene, high-density polyethylene, polypropylene, polybutylene and polypentene; copolymers of two or more olefins such as ethylene/propylene copolymer; and mixtures thereof. Polyolefins having various values of density and melt viscosity index (melt index or hereinafter abbreviated as MI) may be used either on their own or as admixtures.

The resin layer serving as a coating on the paper base, for example, the resin layer formed of one or more of the polyolefin resins described above, preferably contains a white pigment exemplified by titanium dioxide, zinc oxide, talc or calcium carbonate, with titanium dioxide being particularly preferred. It is also preferable to incorporate various other additives in suitable combinations, including aliphatic acid amides such as stearylamide and arachidic acid amide, metal salts of aliphatic acids such as zinc stearate, calcium stearate, magnesium stearate and calcium palmitate, pigments and dyes such as ultramarine blue and cobalt violet, antioxidants, brighteners and uv absorbers. In a particularly preferred embodiment, titanium dioxide is incorporated in an amount of 5–20 wt % of the resin layer on the side of the support (resin-coated paper) where a photographic emulsion layer is to be formed in the resin layer. If ultramarine blue is to be added to the resin layer in combination with a white pigment such as titanium dioxide, it is preferably used in an amount of 0.01–1.0 wt %, more preferably 0.04–0.5 wt %, of the resin layer.

The support useful in the present invention can typically be produced by melt extruding a film of a resin composition through a slit die onto a running paper base, with a titanium dioxide (pigment) being present in the resin composition which is melted under heating. The temperature for melt extrusion is preferably in the range of 200°–350° C. Before the resin composition is applied to the base paper, the surface of the latter is preferably activated by a suitable method such as corona discharge treatment or flame treatment. The thickness of the resin layer in the resin coated paper is not limited to any particular value but it is advantageous for the resin layer to be extrusion coated in a thickness generally ranging from about 5 microns to about 50 microns.

It is necessary for the present invention that the surface of the support on the side where the hydrophilic colloidal layer described above is to be coated (hence the side where an emulsion layer is to be formed) should have a center-line-average roughness, Ra, of 0.3–1.5 μm, with the range of 0.5–1.2 μm being desirable. If Ra is less than 0.3 μm, flare can be a problem when the processed light-sensitive material is used as an original for plate-making with a process camera. If Ra exceeds 1.5 μm, the reflection density will decrease progressively with a correspondingly pronounced deterioration of sharpness.

The surface of the support where the hydrophilic colloidal layer is to be coated may be textured in a desired way such as matting or silk-finishing depending on the specific use of the light-sensitive material. The textured surface must have a surface roughness within the range specified above irrespective of the type of texturing. With ordinary resin coated paper which has both sides of a paper base coated with a resin, the resin surface containing titanium dioxide as a pigment may be matted or silk-finished depending on a specific use. The back side of this support opposite to the resin layer is usually matted. The resin surface, or both sides of the support if necessary, may also be activated by a suitable method such as corona discharge treatment of flame treatment.

The paper base for use in the practice of the present invention is not limited in any way and may be either ordinary natural pulp paper or synthetic paper. The more advantageous is natural pulp paper which is chiefly composed of softwood pulp, hardwood pulp or wood pulp consisting of a mixture of softwood pulp and hardwood pulp. The thickness of the base paper is not limited to any particular value but a paper base having a high degree of surface smoothness is preferred, with its basis weight preferably ranging from 50 to 250 g/m$^2$.

A variety of polymeric compounds or additives may be incorporated in the base paper chiefly composed of natural pulp and which is advantageously used in the practice of the present invention. Examples of useful additives include: agents for improving the dry strength of paper such as cationically converted starch, cationically converted polyacrylamide, anionically converted polyacrylamide, carboxy-modified polyvinyl alcohol and gelatin; sizing agents such as aliphatic acid salts, rosin derivatives, the emulsified product of dialkyl ketene dimers, petroleum resin emulsions, and ammonium salts of alkyl esters of styrene-maleic anhydride copolymer; pigments such as clay, kaolin, calcium carbonate, barium sulfate and titanium oxide; agents for improving the wet strength of paper such as melamine resins, urea resins and epoxidized polyamide resins; fixing agents such as polyvalent metal salts (e.g., aluminum sulfate and aluminum chloride) and cationically modified polymers (e.g., cationically converted starch); pH modifiers such as sodium hydroxide, sodium carbonate and hydrochloric acid; inorganic electrolytes such as sodium chloride and Glauber's salt; dyes; brighteners; and latices. These additives may be incorporated in suitable combinations.

The following examples are provided for the purpose of further illustrating the present invention. Needless to say, these examples are by no means intended to limit the scope of the present invention.

EXAMPLE 1

In Example 1, a coating solution for anti-halation layer (corresponding to the hydrophilic colloidal layer of the present invention which is to be disposed between a photographic emulsion layer and the support) and a coating solution for emulsion layer were prepared by the following procedures.

Preparation of coating solution for anti-halation layer

To an aqueous gelatin solution, dye (V-1) or (V-4) was added in an amount of 50 mg/m$^2$ or 200 mg/m$^2$, respectively. To the solution, a sodium salt of bis(2-ethylhexyl) 2-sulfosuccinate and a styrene-maleic anhydride copolymer were added as a coating aid and a thickener, respectively, thereby preparing a coating solution for anti-halation layer. The amount of gelatin added was varied in such a way that the resulting anti-halation layer would have the thicknesses noted in Table 1. The thickness of each anti-halation layer was measured by examining a cross section of the coated sample with a scanning electron microscope.

| Preparation of coating solution for emulsion layer | |
|---|---|
| Solution A | |
| Water | 980 ml |
| Sodium chloride | 2.0 g |
| Gelatin | 20 g |
| 0.01% Aqueous solution of potassium hexachloroiridate | 2.8 ml |
| 0.001% Aqueous solution of potassium hexabromorhodate | 2.5 ml |
| Solution B | |
| Water | 380 ml |
| Sodium chloride | 38 g |
| Potassium bromide | 42 g |
| Solution C | |
| Water | 380 ml |

-continued

| Preparation of coating solution for emulsion layer | |
|---|---|
| Silver nitrate | 170 g |

To solution a held at 40° C., solutions B and C were functionally added simultaneously over a period of 80 minutes with the pH and pAg being held at 3 and 7.7, respectively. Following stirring for an additional 5 minutes, the pH of the mixture was adjusted to 5.6 with an aqueous solution of sodium carbonate. Following the usual desalting and washing steps, 500 ml of water and 30 g of gelatin were added and dispersed by stirring at 50° C. for 30 minutes, thereby preparing cubic grains consisting of 35 mol % AgBr and 65 mol % AgCl which had an average size of 0.27 μm.

The pH and pAg of this emulsion were adjusted to 5.5 and 7, respectively, by addition of a 1% aqueous solution of citric acid (10 ml) and a 5% aqueous solution of sodium chloride (10 ml). After addition of a 0.1% aqueous solution of sodium thiosulfate (10 ml) and a 0.2% aqueous solution of chloroauric acid (7 ml), the emulsion was ripened at 57° C. to attain maximum sensitivity.

Thereafter, 0.1% methanol solutions of infrared sensitizing dyes (I-3) and (I-4) were added in respective amounts of 25 ml per mol of silver halide. To the mixture, 25 ml of a 0.5% solution of 1-phenyl-5-mercaptotetrazole (antifoggant), 180 ml of a 1% solution of 4-hydroxy-6-methyl-1,3,3a,7-tetrazaindene (restrainer) and 300 ml of a 10% aqueous gelatin solution were added and the ripening step was stopped. To the mixture, the following additives were further added: 15 ml of a 10% aqueous solution of potassium tri-iso-propylnaphthalenesulfonate (coating aid); 50 ml of a 4% aqueous solution of styrene/maleic acid copolymer and 30 g of a polymer latex of butyl acrylate (thickeners); the emulsified dispersion of oil-soluble brightener (II-3) prepared by the method described below; and the reaction product of tetraquis(vinylsulfonylmethyl)methane and taurine potassium salt in proportions of 1 and 0.25 moles (hardener in an amount of 50 mg per gram of gelation). After stirring, the pH of the mixture was adjusted to 5.6 with citric acid, thereby preparing a coating solution for emulsion layer.

Preparation of brightener emulsified dispersion

A solution of 0.8 g of oil-soluble brightener (II-3) in 25 ml of cresyl diphenyl phosphate and 12 ml of 1-butanol was mixed with 260 ml of a 5% aqueous gelatin solution containing 0.5 g of sodium triisopropylnaphthalenesulfonate and the mixture was treated by ultrasonic dispersion to prepare an emulsified dispersion of the brightener.

Preparation of coating solution for protective layer

To an aqueous gelatin solution, 30 mg/m$^2$ of sodium salt of bis(2-ethylhexyl) 2-sulfosuccinate (coating aid), 40 mg/m$^2$ of polymethyl methacrylate (matting agent; average particle size, 4 μm), 30 mg/m$^2$ of compound (a) shown below (fluorine-containing surfactant) and formaldehyde (hardener in an amount of 10 mg per gram of gelatin) were added to prepare a coating solution for protective layer.

Fluorine-containing surfactant (a)

-continued

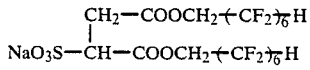

Using the so prepared coating solutions, samples were prepared in the following way: the coating solution for anti-halation layer, the coating solution for emulsion layer and the coating solution for protective layer were simultaneously applied in superposition on polyethylene coated papers 110 μm thick that had a hydrophilic colloidal backing layer and a subbing layer and which contained 15 wt % $TiO_2$. The polyethylene coated papers had a center-line-average roughness, Ra, of 0.6 μm or 1.2 μm as shown in Table 1. Ra measurements were conducted with Perthometer Model S5P of Perthen A.G., West Germany. The prepared samples had a silver deposit of 1.4 g/m$^2$ and gelatin deposits of 1.4 g/m$^2$ in the emulsion layer and 0.9 g/m$^2$ in the protective layer.

The samples were exposed by raster scanning with light (780 nm) from a semiconductor laser. The exposed samples were processed with an automatic developer (Sakura Automatic Processor GR-14 of Konica Corp.) using a developing solution and a fixing solution having the compositions described in Tables 2 and 3, respectively. The processing conditions were as follows development, 38° C.×20 sec; fixing, ca. 38° C.×20 sec; rinsing, R.T.×20 sec; and drying, ca. 40° C.

The resolution of the edge of a straight line about 100 μm wide in each of the processed samples was examined with a magnifying glass (X100) and evaluated for sharpness on a 5-score basis. Score 5 represented the best result and score 1, the worst result. The results are shown in Table 1, from which one can see that sample Nos. 2–4 and 6–8 of the present invention had good sharpness quality as demonstrated by high edge resolution of a straight line.

TABLE 1

| Sample No. | Ra or the surface of the support (μm) | Anti-halation layer Thickness (μm) | Dye Type | Dye Amount (mg/m$^2$) | Edge resolution | Remarks |
|---|---|---|---|---|---|---|
| 1 | 0.6 | 0.2 | V-1 | 50 | 2 | comparison |
| 2 | 0.6 | 0.3 | V-1 | 50 | 3 | the invention |
| 3 | 0.6 | 0.6 | V-1 | 50 | 4 | the invention |
| 4 | 0.6 | 1.2 | V-1 | 50 | 5 | the invention |
| 5 | 1.2 | 0.3 | V-4 | 200 | 2 | comparison |
| 6 | 1.2 | 0.6 | V-4 | 200 | 3 | the invention |
| 7 | 1.2 | 1.2 | V-4 | 200 | 4 | the invention |
| 8 | 1.2 | 1.8 | V-4 | 200 | 4 | the invention |

TABLE 2

| Formulation of Developing Solution | |
|---|---|
| Pure water (ion-exchanged) | ca. 800 ml |
| Potassium sulfite | 60 g |
| Ethylenediaminetetraacetic acid disodium salt | 2 g |
| Potassium hydroxide | 10.5 g |
| 5-Methylbenzotriazole | 300 mg |
| Diethylene glycol | 25 g |
| 1-Phenyl-4,4-dimethyl-3-pyrazolidinone | 300 mg |
| 1-Phenyl-5-mercaptotetrazole | 60 mg |
| Potassium bromide | 3.5 g |

TABLE 2-continued

| | |
|---|---|
| Hydroquinone | 20 g |
| Potassium carbonate | 15 g |
| Pure water (ion-exchanged water) added to make | 1,000 ml |
| pH | ca. 10.8 |

TABLE 3

| Formulation of Fixing Solution | |
|---|---|
| Formulation A | |
| Ammonium thiosulfate (72.5 wt % aq. sol.) | 240 ml |
| Sodium sulfite | 17 g |
| Sodium acetate (trihydrate) | 6.5 g |
| Boric acid | 6 g |
| Sodium citrate (dihydrate) | 2 g |
| Acetic acid (90% w/w aq. sol.) | 13.6 ml |
| Formulation B | |
| Pure water (ion-exchanged) | 17 ml |
| Acetic acid (50% w/w aq. sol.) | 4.7 g |
| Aluminum sulfate (8.1% w/w aq. sol. in terms of $Al_2O_3$) | 26.5 g |

When use, the two formulations A and B were sequentially dissolved in 500 ml of water to make up a total volume of 1,000 ml. The resulting fixing solution had a pH of ca. 4.3.

EXAMPLE 2

In Example 2, the following coating solutions were prepared.

Preparation of coating solution for anti-halation layer

A coating solution for anti-halation layer was prepared as in Example 1 except that dye (IV-1) or (IV-4) was used. The thicknesses of the anti-halation layers formed were as shown in Table 4.

Preparation of coating solution for emulsion layer

A silver halide emulsion having a silver halide composition consisting of 90 mol % AgBr, 9 mol % AgCl and 1 mol % AgI and which comprised octahedral grains with an average size of 0.6 μm was prepared by the ammoniacal method and subsequently subjected to gold sensitization and sulfur sensitization. To the sensitized emulsion were added: 200 mg of sensitizing dye (b) shown below per mole of silver halide; 1 g of 4-hydroxy-6-methyl-1,3,3a,7-tetrazaindene (restrainer); 60 mg of 1-phenyl-5-mercaptotetrazole (antifoggant); 1 g of sodium triisopropylnaphthalenesulfonate (coating aid); 60 g of polyethyl acrylate latex (agent for improving the physical properties of a film); and 20 g of diethylene glycol. To the mixture, the following were further added: the emulsified dispersion of oil-soluble brightener (II- 3) prepared by the method described below; styrene-maleic anhydride copolymer (thickener); and the reaction product of tetraquis (vinyl sulfonylmethyl)methane and taurine potassium salt in proportions of 1 and 0.25 moles (hardener added in an amount of 30 mg per gram of gelatin). As a result, a coating solution for emulsion layer was prepared.

Sensitizing dye (b)

-continued

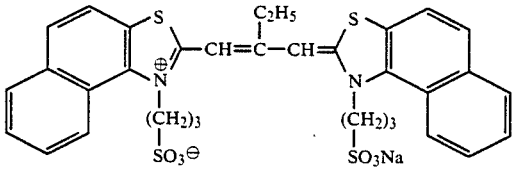

Preparation of brightener emulsified dispersion

A solution of 0.8 g of oil-soluble brightener (II- 3) in 25 ml of cresyl diphenyl phosphate and 12 ml of 1-butanol was mixed with 260 ml of a 5% aqueous gelatin solution containing 0.5 g of sodium triisopropylnaphthalenesulfonate and the mixture was treated by ultrasonic dispersion to prepare an emulsified dispersion of the brightener.

Preparation of coating solution for protective layer

To an aqueous gelatin solution, the following were added: 40 mg/m$^2$ of polymethyl methacrylate (matting agent with an average particle size of 4 μm); 6 mg/m$^2$ of sodium salt of bis(2-ethylhexyl) 2-sulfosuccinate (coating aid); 14 mg/m$^2$ of compound (c) shown below (fluorine-containing surfactant); 100 mg/m$^2$ of compound (III-1) (filter dye); 28 mg of formaldehyde (hardener) per gram of gelatin; and 1 mg/m$^2$ of 1-phenyl-5-mercaptotetrazole (antifoggant). As a result, a coating solution for protective layer was prepared.

Fluorine-containing surfactant (c)

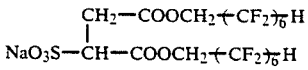

The so prepared coating solution for anti-halation layer, coating solution for emulsion layer and coating solution for protective layer were simultaneously applied in superposition on polyethylene coated papers 110 μm thick that had a hydrophilic colloidal backing layer and which contained 15 wt % $TiO_2$. The polyethylene-coated papers had a center-line-average roughness, Ra, of 0.8 μm or 1.5 μm as shown in Table 4. The prepared samples had a silver deposit of 1.4 g/m$^2$ and gelatin deposits of 1.6 g/m$^2$ in the emulsion layer and 1.5 g/m$^2$ in the protective layer.

The samples were exposed by raster scanning with light from a He-Ne laser and subsequently processed as in Example 1. The resolution of the edge of a straight line in each of the processed samples was examined with a magnifying glass (×100) and evaluated for sharpness on a 5-score basis as in Example I. The results are shown in Table 4, from which one can see that sample Nos. 22–24 and 26–28 of the present invention had good sharpness quality as demonstrated by high edge resolution of a straight line.

TABLE 4

| Sample No. | Ra of the surface of the support (μm) | Anti-halation layer: Thickness (μm) | Dye: Type | Dye: Amount (mg/m$^2$) | Edge resolution | Remarks |
|---|---|---|---|---|---|---|
| 21 | 0.8 | 0.2 | IV-1 | 40 | 2 | comparison |
| 22 | 0.8 | 0.4 | IV-1 | 40 | 3 | the invention |
| 23 | 0.8 | 0.8 | IV-1 | 40 | 4 | the invention |

TABLE 4-continued

| Sample No. | Ra of the surface of the support (μm) | Anti-halation layer: Thickness (μm) | Dye: Type | Dye: Amount (mg/m$^2$) | Edge resolution | Remarks |
|---|---|---|---|---|---|---|
| 24 | 0.8 | 1.6 | IV-1 | 40 | 5 | the invention |
| 25 | 1.5 | 0.3 | IV-4 | 120 | 1 | comparison |
| 26 | 1.5 | 0.8 | IV-4 | 120 | 3 | the invention |
| 27 | 1.5 | 1.5 | IV-4 | 120 | 4 | the invention |
| 28 | 1.5 | 2.0 | IV-4 | 120 | 4 | the invention |

EXAMPLE 3

In Example 3, the following coating solutions were prepared.

Preparation of coating solution for anti-halation layer

A coating solution for anti-halation layer was prepared as in Example 1 except that dye (II-1) or (II-6) was used. The intended thicknesses of anti-halation layers were as shown in Table 5.

Preparation of coating solution for emulsion layer

A coating solution for emulsion layer was prepared as in Example 2 except that 120 mg of compound (d) shown below was used per mole of silver halide as a sensitizing dye:

Sensitizing dye (d)

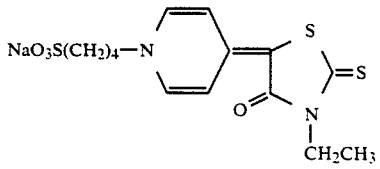

Preparation of coating solution for protective layer

A coating solution for protective layer was prepared as in Example 2 except that compound (IV-1) was added in an amount of 12 mg/m$^2$ as a filter dye.

The so prepared coating solutions were applied on polyethylene coated papers as in Example 2. The polyethylene coated papers had a center-line-average roughness, Ra, of 0.6 μm or 1.2 μm as shown in Table 5. The prepared samples had a silver deposit of 1.4 g/m$^2$ and gelatin deposits of 1.6 g/m$^2$ in the emulsion layer and 1.5 g/m$^2$ in the protective layer.

The so prepared samples were placed in contact with a CTF evaluating mask that had been prepared by vacuum-depositing an Inconel alloy on a glass plate in such a way that the spatial frequency would vary stepwise from 1 line/mm to 50 lines/mm. The samples were then exposed for $10^{-6}$ seconds under a xenon light source. Thereafter, the exposed samples were processed as in Example 1 and CTF analysis was conducted on the processed samples by measurement with Sakura Microdensitometer Model PDM-5 (Konica Corp.). The term "CTF" is the acronym for contrast transfer function. In MTF, the input light varies sinusoidally in intensity whereas in CTF the input light is rectangular wave. The results of analyses by the two methods are transformable to each other. In CTF, a maximum value is 1.0, which, other conditions being equal, represents the highest degree of sharpness. The results of evaluation by CTF analysis are shown in Table 5 for two values of spatial frequency, 15 lines/mm and 30 lines/mm. As one can see from Table 5, sample Nos. 32–34 and 36–38 of the present invention had good sharpness quality as evidenced by high CTF values.

TABLE 5

| Sample No. | Ra of the surface of the support (μm) | Anti-halation layer Thickness (μm) | Dye Type | Dye Amount (mg/m²) | CTF 15 lines/mm | CTF 30 lines/mm | Remarks |
|---|---|---|---|---|---|---|---|
| 31 | 0.6 | 0.2 | II-1 | 50 | 0.50 | 0.30 | comparison |
| 32 | 0.6 | 0.3 | II-1 | 50 | 0.55 | 0.34 | the invention |
| 33 | 0.6 | 0.6 | II-1 | 50 | 0.58 | 0.36 | the invention |
| 34 | 0.6 | 1.2 | II-1 | 50 | 0.60 | 0.38 | the invention |
| 35 | 1.2 | 0.3 | II-6 | 50 | 0.45 | 0.24 | comparison |
| 36 | 1.2 | 0.6 | II-6 | 50 | 0.50 | 0.28 | the invention |
| 37 | 1.2 | 1.2 | II-6 | 50 | 0.52 | 0.30 | the invention |
| 38 | 1.2 | 1.8 | II-6 | 50 | 0.53 | 0.30 | the invention |

EXAMPLE 4

Preparation of coating solution for emulsion layer

An emulsion that was prepared as in Example 1 was divided into several portions, each of which was mixed with 50 ml of a 0.1% methanol solution of one of the infrared sensitizing dyes shown in Table 7 (under illustrative compound number or by the structural formulas (g)–(i) given below per mole of silver halide. To each of the mixtures, 25 ml of a 0.5% solution of 1-phenyl-5-mercaptotetrazole (antifoggant), 180 ml of a 1% solution of 4-hydroxy-6-methyl-1,3,3a,7-tetrazaindene (restrainer) and 300 ml of a 10% aqueous gelatin solution were added, and the ripening of the emulsion was stopped. To each of the stirred mixtures, 15 ml of a 10% aqueous solution of sodium tri-iso-propylnaphthalenesulfonate (coating aid), 50 ml of a 4% aqueous solution of styrene-maleic anhydride copolymer and 30 g of polymer latex of butyl acrylate (thickeners), and 20 ml of a 20% aqueous solution of hydroquinone and 20 ml of a 10% aqueous solution of potassium bromide (restrainer) were added. After adding the reaction product of tetraquis(vinylsulfonylmethyl)methane and taurine potassium salt in proportions of 1 and 0.25 moles as a hardener in an amount of 50 mg per gram of gelatin, the pH of each mixture was adjusted to 5.6 with citric acid, thereby preparing a coating solution for emulsion layer. With sample Nos. 39–42 and 45, the emulsified dispersion described in Table 6 was added to the emulsion layer in such an amount that the deposit of brightener would be 30 mg/m².

Preparation of coating solution for anti-halation layer

To an aqueous solution containing 40 g of gelatin, dye V-4)shown below was added to give a deposit of 200 mg/m². By further adding 15 ml of a 4% aqueous solution of styrene-maleic anhydride copolymer (thickener), a coating solution for anti-halation layer was prepared. With sample Nos. 43–44, the emulsified dispersion described in Table 6 was added to the anti-halation layer in such an amount that the deposit of brightener would be 30 mg/m².

Dye (V-4)

-continued

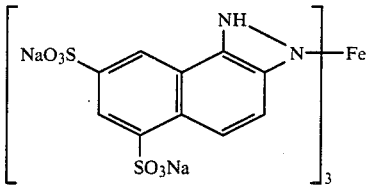

Preparation of coating solution for protective layer

To an aqueous gelatin solution, 30 mg/m² of sodium salt of bis(2-ethylhexyl) 2-sulfosuccinate (coating aid), 40 mg/m² of polymethyl methacrylate (matting agent having an average particle size of 4 μm), 30 mg/m² of compound (f) shown below (fluorine-containing surfactant) and 10 mg of formaldehyde (hardener) per gram of gelatin were added so as to prepare a coating solution for protective layer.

Fluorine-containing surfactant (f)

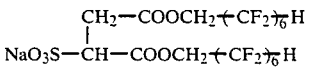

Preparation and evaluation of samples

The so prepared coating solution for anti-halation layer, coating solution for emulsion layer and coating solution for protective layer were applied simultaneously in superposition on polyethylene coated papers 110 μm thick (Ra=1.2 μm) that had a hydrophilic colloidal backing layer and a subbing layer and which contained 15 wt % $TiO_2$. The prepared samples had a silver deposit of 1.4 g/m² and gelating deposits of 1.4 g/m² in both the anti-halation layer and the emulsion layer and 0.9 g/m² in the protective layer, said anti-halation layer having a thickness of 1.8 μm.

The so prepared samples were exposed for $10^{-5}$ seconds with a xenon flash light source through an optical wedge and Kodak Wratten filter No. 88A. The exposed samples were processed with an automatic developer (Sakura Automatic Processor GR-14 of Konica Corp.) using a developing solution and a fixing solution having the same compositions as those employed in Example 1. The photographic characteristics of the processed samples were evaluated. The processing conditions were as follows: development, 30° C.×20 sec; fixing, ca. 38° C.×20 sec; rinsing, R.T.×20 sec; and drying, ca. 40° C.

The results are shown in Table 7. The sensitivity is the reciprocal of the amount of exposure necessary to produce a density of 1.0 and is expressed in relative terms with the value for sample No. 39 being taken as 100.

Intensity of fluorescence was measured for the reflection density of the unexposed areas of a processed sample under a xenon lamp using a color analyzer Model 607 of Hitachi, Ltd. The relative intensity of fluorescence is expressed in terms of the relative amount of decrease in reflection density at 440 nm resulting from the addition of a brightener.

TABLE 6

Preparation of Emulsified Dispersion of Oil-soluble Brightener

Five grams of an oil-soluble brightener (II-1 or II-3) was dissolved in a mixture of cresy phenyl phosphate (100 ml) and ethyl acetate (100 m). The entire portion of the solution was mixed with 1500 ml of a 12% aqueous gelatin solution containing 3 g of sodium tripropylnaphthalenesulfonate and the mixture was treated by ultrasonic dispersion to form an emulsified dispersion.

Thereafter, a polymer latex of butyl acrylate was added in an amount of 10 g on a solids basis, thereby preparing the emulsified dispersion of the oil-soluble brightener.

Sensitizing dyes (g)

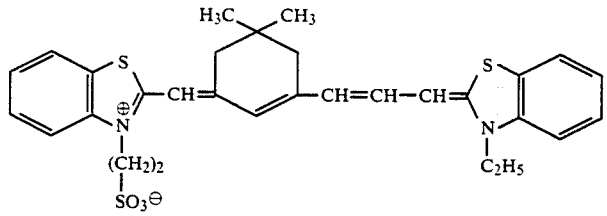

(h)

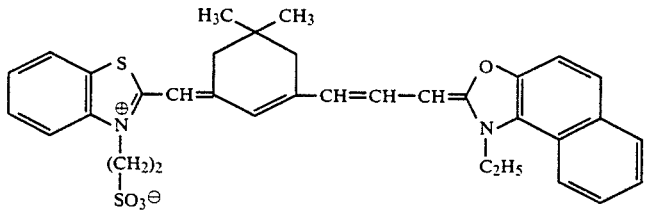

(i)

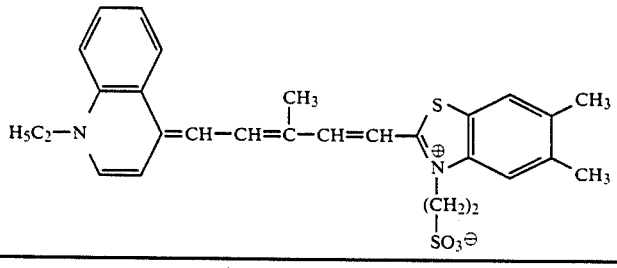

TABLE 7

| Sample No. | Sensitizing dye | Brightener type | Brightener location | Relative sensitivity | Relative fluorescence intensity | Remarks |
|---|---|---|---|---|---|---|
| 39 | I-1 | II-1 | emulsion layer | 100 | 100 | the invention |
| 40 | (g) | II-1 | emulsion layer | 80 | 90 | the invention |
| 41 | I-4 | II-3 | emulsion layer | 110 | 100 | the invention |
| 42 | (h) | II-3 | emulsion layer | 90 | 90 | the invention |
| 43 | I-11 | II-3 | AH layer* | 90 | 100 | the invention |
| 44 | (i) | II-3 | AH layer | 70 | 90 | the invention |
| 45 | I-3 and I-4 in equal portions | II-3 | emulsion layer | 110 | 100 | the invention |

*AH layer: antihalation layer

What is claimed is:

1. A silver halide photographic material that has a photographic emulsion layer formed on a support comprising paper base coated with a resin on both sides wherein a hydrophilic colloidal layer containing a material that has an absorption in the wavelength region in which the photographic emulsion layer has sensitivity is provided between the emulsion layer and the support, and that the surface of the support on the side where the hydrophilic colloidal layer is to be coated has a center-line-average roughness, Ra, of 0.3–1.5 μm, the thickness of this hydrophilic colloidal layer being at least one half the center-line-average roughness, Ra, of the surface of said support.

2. A silver halide photographic material according to claim 1 wherein said material having an absorption in the wavelength region in which the photographic emulsion layer has sensitivity is a dye.

3. A silver halide photographic material according to claim 2 wherein said dye is at least one member of the group consisting of cyanine, hemicyanine, streptocyanine, merocyanine, oxonole, hemioxonole, styryl, rhodacyanine, neocyanine, azo and anthraquinone dyes.

4. A silver halide photographic material according to claim 2 wherein said dye has an acid group.

5. A silver halide photographic material according to claim 1 wherein said material having an absorption in the wavelength region in which the photographic emulsion layer has sensitivity is incorporated in such an amount that the reflection density of the photographic emulsion layer at the wavelength of maximum sensitivity is at least 0.1.

6. A silver halide photographic material according to claim 5 wherein said material having an absorption in the wavelength region in which the photographic emulsion layer has sensitivity is incorporated in such an amount that the reflection density of the photographic emulsion layer at the wavelength of maximum sensitivity is at least 0.3.

7. A silver halide photographic material according to claim 1 wherein said hydrophilic colloidal layer has a thickness not smaller than Ra.

8. A silver halide photographic material according to claim 1 wherein Ra is within the range of 0.5–1.2 μm.

9. A silver halide photographic material according to claim 1 which is silver halide photographic paper.

10. A silver halide photographic material according to claim 9 wherein at least one photographic emulsion layer is spectrally sensitized with either a cationic tricarbocyanine dye or a cationic dicarbocyanine dye or both and an emulsified dispersion or latex dispersion of an oil-soluble brightener is contained in at least one hydrophilic colloidal layer including said photographic emulsion layer which is coated on the same side as where said photographic emulsion layer is disposed.

11. A silver halide photographic material according to claim 10 wherein said sensitizing dye is a compound represented by the following general formula (I-a) or (I-b):

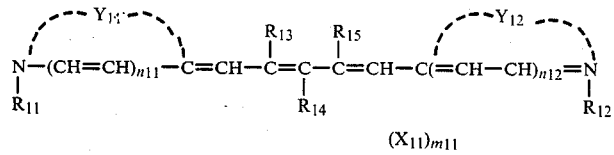

(I-a)

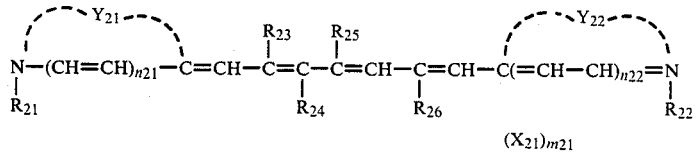

(I-b)

where $Y_{11}$, $Y_{12}$, $Y_{21}$ and $Y_{22}$ each represents the nonmetallic atomic group necessary to complete a 5- or 6-membered nitrogenous heterocyclic ring; $R_{11}$, $R_{12}$, $R_{21}$and $R_{22}$ each represents a lower alkyl group, an alkyl group having a sulfo group, or an alkyl group having a carboxyl group; $R_{13}$, $R_{14}$, $R_{15}$, $R_{23}$, $R_{24}$, $R_{25}$ and $R_{26}$ each represents a a hydrogen atom, a substituted or unsubstituted alkyl, alkoxy, phenyl or benzyl group or substituted or unsubstituted

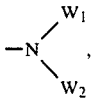

where $W_1$ and $W_2$ each signifies a substituted or unsubstituted alkyl or aryl group, provided that $W_1$ and $W_2$ may combine with each other to form a 5- or 6-membered nitrogenous heterocyclic ring; $R_{13}$ and $R_{15}$ or $R_{23}$ and $R_{25}$ may combine with each other to form a 5- or 6-membered ring; $X_{11}$ and $X_{21}$ each represents an anion; $n_{11}$, $n_{12}$, $n_{21}$ and $n_{22}$ each represents 0 or 1; $m_{11}$ and $m_{21}$ each represents 1 or 0 (an intramolecular salt is represented if they are 0).

12. A silver halide photographic material according to claim 10 wherein the sensitizing dye is incorporated in said photographic emulsion layer in an amount of from 1 mg to 2 g per mole of silver halide.

13. A silver halide photographic material according to claim 12 wherein the sensitizing dye is incorporated in said photographic emulsion layer in an amount of from 5 mg to 1 g per mole of silver halide.

14. A silver halide photographic material according to claim 10 wherein said oil-soluble brightener is a compound represented by either one of the following general formulas (II-a) to (II-d):

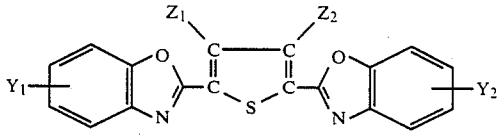

(II-a)

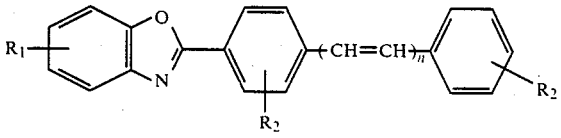

(II-b)

-continued

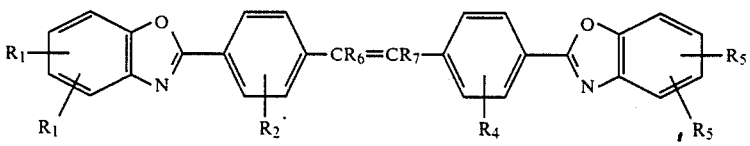

(II-c)

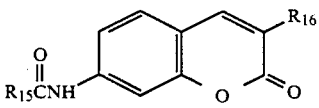

(II-d)

where $Y_1$ and $Y_2$ each represents an alkyl group; $Z_1$ and $Z_2$ each represents a hydrogen atom or an alkyl group; n is 1 or 2; $R_1$, $R_2$, $R_4$ and $R_5$ each represents an aryl, alkyl, alkoxy, aryloxy, hydroxyl, amino, cyano, carboxyl, amido, ester, alkylcarbonyl, alkylsulfo or dialkylsulfonyl group or a hydrogen atom; $R_6$ and $R_7$ each represents a hydrogen atom, an alkyl group or a cyano group; $R_{16}$ is a phenyl group, a halogen atom, or an alkyl-substituted phenyl group; and $R_{15}$ is an amino group or an organic primary or secondary amine.

15. A silver halide photographic material according to claim 10 wherein said oil-soluble brightener is incorporated in an amount of 1–200 mg/m$^2$.

16. A silver halide photographic material according to claim 15 wherein said oil-soluble brightener is incorporated in an amount of 5–50 mg/m$^2$.

17. A silver halide photographic material according to claim 10 wherein said oil-soluble brightener is incorporated in at least one of said photographic emulsion layers.

18. A silver halide photographic material according to claim 1 wherein said resin coated on both sides of the support is a polyolefinic resin.

19. A silver halide photographic material according to claim 1 wherein said resin coated on both sides of the support contains a white pigment.

20. A silver halide photographic material according to claim 19 wherein said white pigment is titanium di-oxide.

21. A silver halide photographic material according to claim 20 wherein said titanium di-oxide is incorporated in an amount of 5–20 wt % in said resin.

* * * * *